US008552968B2

(12) United States Patent
Chung et al.

(10) Patent No.: US 8,552,968 B2
(45) **Date of Patent: *Oct. 8, 2013**

(54) LIQUID CRYSTAL DISPLAY DEVICE AND DRIVING METHOD THEREOF

(75) Inventors: Injae Chung, Gwacheon-si (KR); Kiduk Kim, Gunpo-si (KR); Euitae Kim, Seoul (KR); Yongwoo Choi, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 996 days.

This patent is subject to a terminal disclaimer.

(21) Appl. No.: 12/588,051

(22) Filed: Oct. 1, 2009

(65) Prior Publication Data

US 2010/0085375 A1 Apr. 8, 2010

(30) Foreign Application Priority Data

Oct. 2, 2008 (KR) ..... 10-2008-0097274

(51) Int. Cl.
*G09G 3/36* (2006.01)

(52) U.S. Cl.
USPC ..... 345/102; 345/76; 345/77; 345/89; 345/204; 345/211; 345/214; 345/690; 362/97.2

(58) Field of Classification Search
USPC ..... 345/102, 76–77, 87, 89, 204, 211–214, 345/691, 589, 690; 362/97.1–97.3
See application file for complete search history.

(56) References Cited

U.S. PATENT DOCUMENTS

| | | | | |
|---|---|---|---|---|
| 5,757,365 | A * | 5/1998 | Ho | 345/212 |
| 5,790,096 | A | 8/1998 | Hill, Jr. | |
| 6,690,499 | B1 * | 2/2004 | Larsen et al. | 359/238 |
| 2002/0063670 | A1 * | 5/2002 | Yoshinaga et al. | 345/87 |
| 2002/0180675 | A1 * | 12/2002 | Tobita et al. | 345/87 |
| 2004/0150647 | A1 * | 8/2004 | Aleksic et al. | 345/555 |
| 2005/0093808 | A1 * | 5/2005 | Kang et al. | 345/99 |
| 2005/0140631 | A1 * | 6/2005 | Oh et al. | 345/89 |
| 2007/0035533 | A1 * | 2/2007 | Kim | 345/204 |
| 2008/0246749 | A1 * | 10/2008 | Lee et al. | 345/207 |

FOREIGN PATENT DOCUMENTS

| | | |
|---|---|---|
| TW | 527497 | 4/2003 |
| TW | I242179 | 10/2005 |
| TW | I286723 | 9/2007 |
| TW | 200822033 | 5/2008 |
| TW | 200834530 | 8/2008 |

* cited by examiner

*Primary Examiner* — Lun-Yi Lao
*Assistant Examiner* — Sosina Abebe
(74) *Attorney, Agent, or Firm* — McKenna Long & Aldridge, LLP

(57) ABSTRACT

A liquid crystal display (LCD) and a method of driving the same are disclosed. The liquid crystal display includes a liquid crystal display panel; a backlight unit; a panel drive circuit; a timing controller; an internal memory; a self-screen drive controller; a scaler unit; a selection unit; an internal power circuit; an external power circuit; and a microprocessor that blocks an output of the external power circuit from being supplied to the scaler unit in a self-screen drive.

18 Claims, 5 Drawing Sheets

LIQUID CRYSTAL DISPLAY DEVICE AND DRIVING METHOD THEREOF

This application claims the benefit of Korea Patent Application No. 10-2008-0097274 filed on Oct. 2, 2008, which is incorporated herein by reference for all purposes as if fully set forth herein.

BACKGROUND OF THE INVENTION

1. Field of the Invention

Embodiments of the invention relate to a liquid crystal display and a method of driving the same providing an interior design at low power consumption.

2. Discussion of the Related Art

Liquid crystal displays (LCDs) display an image by controlling light transmittance of a liquid crystal layer with an electric field in response to a video signal. The liquid crystal display is also a flat panel display device having advantages such as a thin profile, small size, and low power consumption. Thus, liquid crystal displays are used in personal computers such as notebook PCs, office automation equipment, audio/video equipment, and the like.

In addition, an active-matrix type liquid crystal display (AMLCD) includes a switching element formed in each liquid crystal cell. Therefore, the active matrix type liquid crystal display is advantageous for displaying a moving picture, because the switching elements can be actively controlled. Further, a thin-film transistor (TFT) is used in the switching element of the active-matrix type liquid crystal display.

In more detail, and with reference to FIG. 1, an active-matrix type liquid crystal display converts digital video data into an analog voltage based on a gamma reference voltage. This supplies the analog data voltage to a data line DL, and at the same time, supplies a scan pulse to a gate line GL. Hence, a liquid crystal cell Clc is charged to a data voltage. For the above-described operation, a gate electrode of a TFT is connected to the gate line GL, a source electrode of the TFT is connected to the data line DL, and a drain electrode of the TFT is connected to a pixel electrode of the liquid crystal cell Clc and an electrode at one side of a storage capacitor Cst. Further, a common voltage Vcom is supplied to a common electrode of the liquid crystal cell Clc.

When the TFT is turned on, the storage capacitor Cst is charged to the data voltage received from the data line DL to keep a voltage of the liquid crystal cell Clc constant. The TFT is turned on when the scan pulse is supplied to the gate line GL. Thus, a channel is formed between the source electrode and the drain electrode of the TFT, and a voltage on the data line DL is supplied to the pixel electrode of the liquid crystal cell Clc. In addition, when an arranged state of liquid crystal molecules of the liquid crystal cell Clc changes by an electric field between the pixel electrode and the common electrode, incident light is modulated.

A liquid crystal display like a liquid crystal display television (LCD TV) generally includes a liquid crystal display panel, a backlight unit, a liquid crystal module including drive circuits with a controller, and a system module including a scaler and a power unit.

Pixels each having a structure illustrated in FIG. 1 are formed on the liquid crystal display panel. The backlight unit is mainly classified into a direct type backlight unit and an edge type backlight unit. In the edge type backlight unit, light sources are installed outside the liquid crystal display panel, and light from the light sources is incident on the entire surface of the liquid crystal display panel using a transparent light guide plate. In the direct type backlight unit, light sources are installed in the rear of the liquid crystal display panel, and light from the light sources is directly incident on the entire surface of the liquid crystal display panel. The direct type backlight unit can increase a luminance and a light emitting surface as compared with the edge type backlight unit because of the plurality of light sources. Therefore, in case of a LCD TV requiring a large-screen liquid crystal display panel, the direct type backlight unit is generally used. The drive circuits include a gate drive circuit, a data drive circuit, a backlight drive circuit, and the like. The controller includes a timing controller, and the like.

The scaler performs image processing on an image received from the outside, so that the image is suitable to be displayed on the liquid crystal module. Further, the scaler generates sync signals synchronized with the image. The power unit includes a driving power supply for driving the liquid crystal module, the scaler, and an audio device and generates a power for driving the liquid crystal display.

However, the related art liquid crystal display has the following problems. First, when the liquid crystal display is used as a TV, for example, and is mounted on a wall, the liquid crystal display has a dark or black appearance when it is not used. Further, many liquid crystal displays are large in size, and thus the liquid crystal display has an unattractive appearance when it is not being used, especially when the liquid crystal display is used in a home, office, work environment, etc. In addition, the amount of power consumption used by the display has greatly increased especially with a trend of large sized and high definition (HD) liquid crystal displays. The high power consumption disadvantageously affects liquid crystal displays.

SUMMARY OF THE INVENTION

Embodiments of the invention provide a liquid crystal display and a method of driving the same providing an interior design at low power consumption.

In one aspect, there is a liquid crystal display comprising a liquid crystal display panel, a backlight unit that provides light to the liquid crystal display panel, a data drive circuit that drives data lines of the liquid crystal display panel, a gate drive circuit that drives gate lines of the liquid crystal display panel, a backlight drive circuit that adjusts a luminance of the backlight unit, a timing controller that supplies a video signal to the data drive circuit and generates timing control signals for controlling an operation timing of each of the data drive circuit, the gate drive circuit, and the backlight drive circuit using timing signals, an internal memory that stores a first internal video signal for a self-screen drive, a self-screen drive controller that generates a dimming signal having a dimming ratio less than a dimming ratio in a normal drive and generates an internal timing signal to extract the first internal video signal from the internal memory, a scaler unit that generates an external video signal and an external timing signal for the normal drive, a selection unit that supplies one of an output of the self-screen drive controller and an output of the scaler unit to the timing controller in response to a selection signal depending on a driving mode, an internal power circuit that generates driving voltages required to drive the data drive circuit, the gate drive circuit, the backlight drive circuit, the timing controller, and the self-screen drive controller, an external power circuit that generates a power input to the internal power circuit and generates a power of circuits constituting the scaler unit, and a microprocessor that blocks an output of the external power circuit from being supplied to the scaler unit in the self-screen drive and controls the self-screen drive controller to reduce a luminance of the backlight unit.

The liquid crystal display further comprises an external storing unit that stores a second internal video signal used to update the first internal video signal.

The microprocessor allows an output of the external power circuit to be supplied to the scaler unit every time a driving time in the self-screen drive exceeds a predetermined period of time and thus allows the second internal video signal stored in the external storing unit to be stored in the internal memory via the scaler unit and the self-screen drive controller.

The liquid crystal display further comprises an oscillator that generates an oscillation clock used to generate the internal timing signal.

The self-screen drive controller includes an internal timing signal generating unit that generates the internal timing signal using a resolution information of the liquid crystal display panel and the oscillation clock, a dimming ratio controller that generates the dimming signal to reduce the luminance of the backlight unit, and a memory controller that controls extraction and update operations of the internal video signal.

Supposing that a power consumption of the backlight unit having a maximum dimming ratio in the normal drive is 100%, the dimming ratio controller sets a brightness of the dimming signal in the self-screen drive within range of power consumption of 10%.

The liquid crystal display further comprises an illuminance sensing unit that senses an external illuminance.

A dimming ratio of the dimming signal in the self-screen drive increases within range of power consumption of 10% as the external illuminance increases.

The internal timing signal generating unit generates an internal timing signal that corresponds to an external timing signal synchronized with a frame frequency of F-value and is synchronized with a minimum frame frequency, at which a flicker is invisible, among frame frequencies less than a frame frequency of F/2.

The selection signal is generated by the microprocessor based on a mode signal received through a user interface, and a logic level of the selection signal changes depending on a driving mode and data update.

After k frame periods elapsed from immediately after a logic level of the selection signal is inverted, the self-screen drive controller stores the first internal video signal in the internal memory.

The self-screen drive controller inserts black data or displays a black image on the liquid crystal display panel by turning off the backlight unit during the k frame periods on the basis of a rising edge of the selection signal, so as to remove screen noise that is likely to be generated when the logic level of the selection signal is inverted.

An interface circuit for the self-screen drive is the same as an interface circuit for the normal drive.

In another aspect, there is a method of driving a liquid crystal display including a liquid crystal display panel, a backlight unit providing light to the liquid crystal display panel, a data drive circuit driving data lines of the liquid crystal display panel, a gate drive circuit driving gate lines of the liquid crystal display panel, a backlight drive circuit adjusting a luminance of the backlight unit, a timing controller that supplies a video signal to the data drive circuit and generates timing control signals for controlling an operation timing of each of the data drive circuit, the gate drive circuit, and the backlight drive circuit using timing signals, a scaler unit generating an external video signal and an external timing signal for a normal drive, an internal power circuit generating driving voltages required to drive the data drive circuit, the gate drive circuit, the backlight drive circuit, and the timing controller, and an external power circuit that generates a power input to the internal power circuit and generates a power of circuits constituting the scaler unit, the method comprising deciding whether or not a mode signal received from the outside indicates a self-screen drive, if the mode signal indicates the self-screen drive, blocking an output of the external power circuit from being supplied to the scaler unit, generating an internal timing signal to extract a first internal video signal previously stored for the self-screen drive from an internal memory, and generating a dimming signal having a dimming ratio less than a dimming ratio in the normal drive, and supplying the internal timing signal and the first internal video signal to the timing controller in response to a selection signal for the self-screen drive to display the first internal video signal on the liquid crystal display panel to reduce a luminance of the backlight unit using the dimming signal.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

Figure 1:
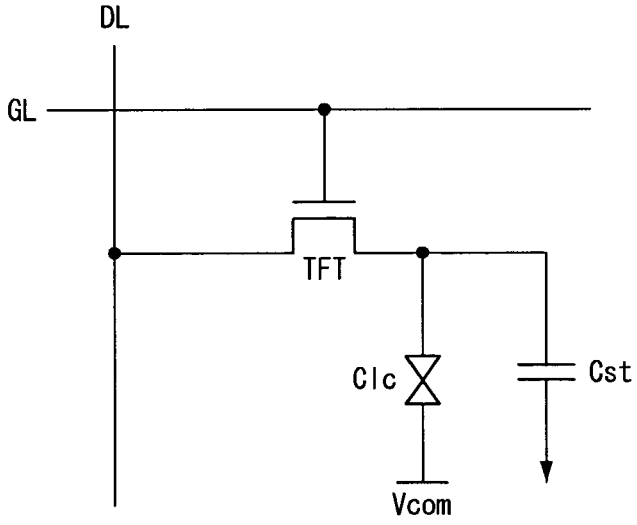
FIG. 1 (Related Art)
FIG. 1 is an equivalent circuit diagram of a pixel of a related art liquid crystal display.
Figure 2:
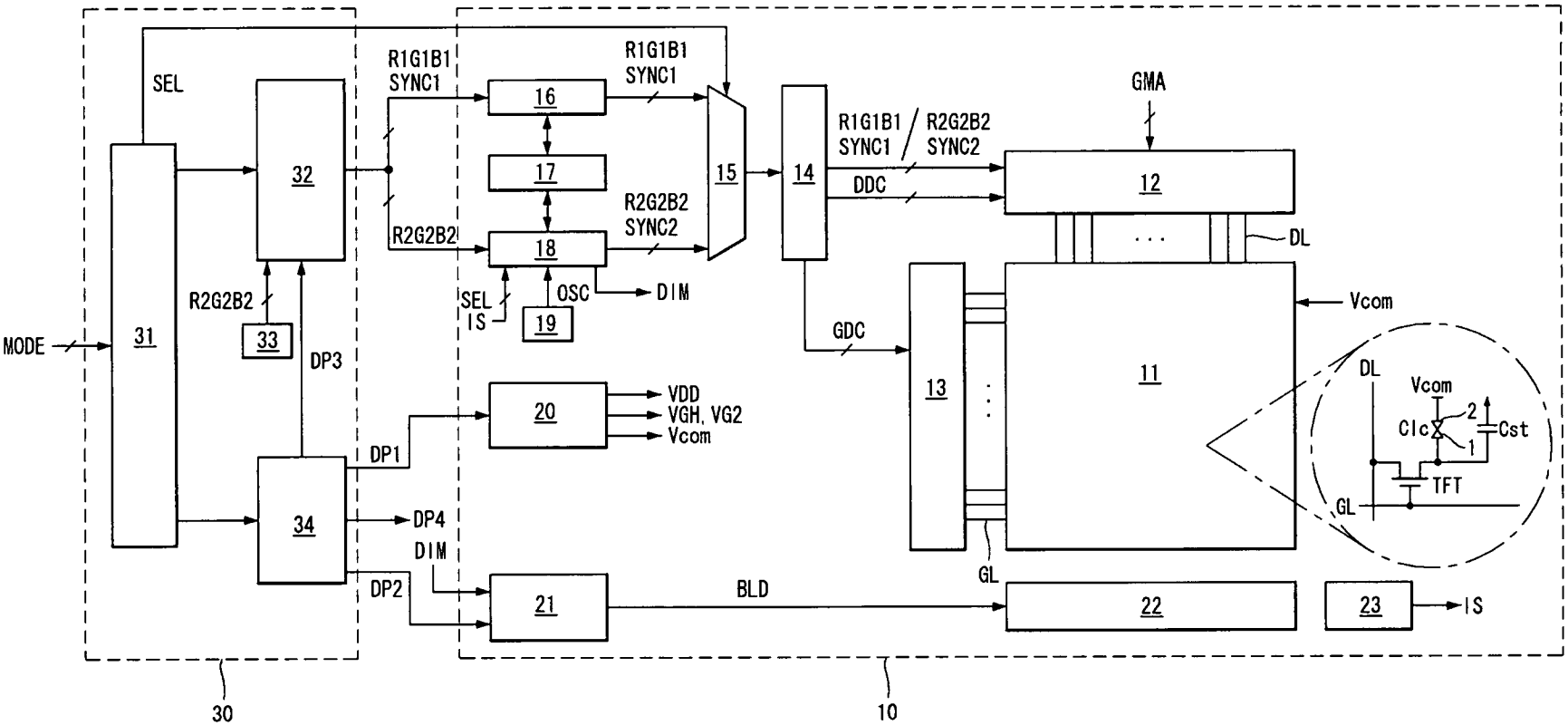
FIG. 2 is a block diagram of a liquid crystal display according to an embodiment of the invention.

FIG. 2 is a block diagram of a liquid crystal display according to an embodiment of the invention.

As shown in FIG. 2, the liquid crystal display includes a liquid crystal module 10 displaying an image and a system module 30 supplying a driving signal to the liquid crystal module 10.

The liquid crystal module 10 includes a liquid crystal display panel 11, a data drive circuit 12, a gate drive circuit 13, a timing controller 14, a multiplexer 15, a first controller 16, a memory 17, a second controller 18, an oscillator 19, a DC-DC converter 20, a backlight drive circuit 21, a backlight unit 22, and an illuminance sensing unit 23.

The liquid crystal display panel 11 includes an upper glass substrate, a lower glass substrate, and a liquid crystal layer between the upper and lower glass substrates. The liquid crystal display panel 11 includes m×n liquid crystal cells Clc arranged in a matrix format at each crossing of m data lines DL and n gate lines GL.

The data lines DL, the gate lines GL, thin film transistors (TFTs), and a storage capacitor Cst are formed on the lower glass substrate of the liquid crystal display panel 11. The liquid crystal cells Clc are connected to the TFTs and are driven by an electric field between pixel electrodes 1 and common electrodes 2. A black matrix, a color filter, and the common electrodes 2 are formed on the upper glass substrate of the liquid crystal display panel 11. The common electrode 2 is formed on the upper glass substrate in a vertical electric drive manner, such as a twisted nematic (TN) mode and a vertical alignment (VA) mode. The common electrode 2 and the pixel electrode 1 are formed on the lower glass substrate in a horizontal electric drive manner, such as an in-plane switching (IPS) mode and a fringe field switching (FFS) mode. Polarizing plates are attached respectively to the upper and lower glass substrates. Alignment layers for setting a pre-tilt angle of the liquid crystal are respectively formed on the upper and lower glass substrates.

The data drive circuit 12 converts an external video signal (hereinafter, referred to as first digital video data R1G1B1) for a normal drive or an internal video signal (hereinafter, referred to as second digital video data R2G2B2) for a self-screen drive into an analog gamma compensation voltage based on gamma reference voltages GMA received from a gamma reference voltage generation circuit (not shown) in response to a data control signal DDC received from the timing controller 14 to supply the analog gamma compensation voltage as a data voltage to the data lines DL of the liquid crystal display panel 11. For the above-described operation, the data drive circuit 12 includes a plurality of data drive integrated circuits (ICs) each including a shift resistor, a resistor, a latch, a digital-to-analog converter (DAC), a multiplexer, an output buffer, and so on. The shift resistor samples a clock signal, and the resistor temporarily stores the first digital video data R1G1B1 or the second digital video data R2G2B2. The latch stores the digital video data R1G1B1/R2G2B2 every 1 line in response to the clock signal sampled by the shift resistor and simultaneously outputs the stored digital video data R1G1B1/R2G2B2 of each line. The DAC selects a positive or negative gamma voltage based on a gamma reference voltage in response to a digital data value from the latch. The multiplexer selects the data lines DL receiving analog data converted from the positive/negative gamma voltage. The output buffer is connected between the multiplexer and the data lines DL.

The gate drive circuit 13 sequentially supplies a scan pulse for selecting horizontal lines of the liquid crystal display panel 11, to which the data voltage will be supplied, to the gate lines GL. For the above operation, the gate drive circuit 13 includes a plurality of gate drive ICs each including a shift resistor, a level shifter for shifting an output signal of the shift resistor to a swing width suitable for a TFT drive of the liquid crystal cell Clc, and an output buffer connected between the level shifter and the gate lines GL.

The timing controller 14 receives timing signals, such as an external timing signal (hereinafter, referred to as a first sync signal SYNC1) or an internal timing signal (hereinafter, referred to as a second sync signal SYNC2) to generate a data timing control signal DDC for controlling operation timing of the data drive circuit 12 and a gate timing control signal GDC for controlling operation timing of the gate drive circuit 13. The data timing control signal DDC includes a source sampling clock signal SSC indicating a latch operation of digital data inside the data drive circuit 12 based on a rising or falling edge, a source output enable signal SOE indicating an output of the data drive circuit 12, a polarity control signal POL indicating a polarity of the data voltage to be supplied to the liquid crystal cells Clc of the liquid crystal display panel 11, and the like. The gate timing control signal GDC includes a gate start pulse GSP, a gate shift clock signal GSC, a gate output enable signal GOE, and the like. The gate start pulse GSP indicates a start horizontal line of a scan operation during 1 vertical period in which one screen is displayed. The gate shift clock signal GSC is a timing control signal that is input to the shift resistor of the gate drive circuit 13 to sequentially shift the gate start pulse GSP, and has a pulse width corresponding to on-period of a thin film transistor (TFT). The gate output enable signal GOE indicates an output of the gate drive circuit 13.

Further, the timing controller 14 rearranges the first digital video data R1G1B1 or the second digital video data R2G2B2 in conformity with a resolution of the liquid crystal display panel 11 to supply the rearranged first digital video data R1G1B1 or the rearranged second digital video data R2G2B2 to the data drive circuit 12.

The multiplexer 15 selects one of an output signal (i.e., R1G1B1 and SYNC1) of the first controller 16 and an output signal (i.e., R2G2B2 and SYNC2) of the second controller 18 in response to a selection signal SEL received from the system module 30 to supply the selected output signal to the timing controller 14. For example, if the multiplexer 15 selects the output signals R1G1B1 and SYNC1 of the first controller 16 in response to the selection signal SEL of a first logic level, the liquid crystal module 10 operates in a normal drive mode. On the other hand, if the multiplexer 15 selects the output signals R2G2B2 and SYNC2 of the second controller 18 in response to the selection signal SEL of a second logic level, the liquid crystal module 10 operates in a self-screen drive mode.

The first controller 16 controlling a normal drive supplies the first digital video data R1G1B1 and the first sync signal SYNC1 received from the system module 30 to one input terminal of the multiplexer 15. The first controller 16 may include at least one of a first modulation unit for improving a response characteristic of the liquid crystal display panel 11 and a second modulation unit for emphasizing a contrast ratio of the liquid crystal display panel 11. The first modulation unit compares previous frame data with current frame data and determines changes in the frame data depending on a comparison result. Then, the first modulation unit extracts a first compensation value according to a determining result from the memory 17 and modulates the first digital video data R1G1B1 using the first compensation value. Thus, the response characteristic of the liquid crystal display panel 11 can be improved. The first modulation unit may achieve a fast response time of the liquid crystal display panel 11 using a modulation method disclosed in detail in Korea Patent Application Nos. 10-2001-0032364 and 10-2001-0057119 corresponding to the present applicant, and which are hereby incorporated by reference in their entirety.

The second modulation unit analyzes a luminance of the first digital video data R1G1B1 corresponding to one screen. Then, the second modulation unit modulates the first digital video data R1G1B1 using second compensation values stored in the memory 17 depending on an analyzing result of luminance to increase a luminance of the first digital video data R1G1B1 to be used in a bright portion of an image and to reduce a luminance of the first digital video data R1G1B1 to be used in a dark portion of the image. At the same time, the second modulation unit controls a luminance of the backlight unit 22 depending on the analyzing result of luminance, so that a brightness of light sources of the backlight unit 22 providing light to the bright portion of the image increases and a brightness of light sources of the backlight unit 22 providing light to the dark portion of the image decreases. As a result, the second modulation unit modulates the luminance of the first digital video data R1G1B1, and at the same time, controls the luminance of the backlight unit 22 to thereby increase a luminance and a contrast ratio of the image. Hence, a dynamic contrast ratio of a moving picture displayed on the liquid crystal display increases. The second modulation unit may increase the contrast ratio of the liquid crystal display panel 11 using a modulation method disclosed in detail in Korea Patent Application Nos. 10-2003-0099334 and 10-2004-0030334 corresponding to the present applicant, and which are hereby incorporated by reference in their entirety.

In the normal drive, the memory 17 stores the first compensation value for improving the response characteristic of the liquid crystal display panel 11 and the second compensation values for improving the contrast ratio of the liquid crystal display panel 11 in the form of a lookup table. In the self-screen drive, the memory 17 stores the second digital video data R2G2B2 corresponding to k frames (where k is an integer equal to or greater than 1) to be displayed. In addition, in the self-screen drive, the memory 17 may store dimming signals DIM for reducing power consumption depending on an external illuminance in the form of a lookup table. The dimming signal DIM is a control signal for controlling a turned-on period of the light sources. It is preferable that a dimming ratio in the self-screen drive is much less than a dimming ratio in the normal drive so as to reduce power consumption in the self-screen drive. For example, supposing that power consumption of the light sources having a maximum dimming ratio in the normal drive is 100%, a brightness of the dimming signal DIM in the self-screen drive may be set within the range of power consumption of 10%. In addition, a dimming ratio of the dimming signal DIM in the self-screen drive increases as an external illuminance increases within the range of power consumption of 10%, so that the dimming signal DIM secures visibility.

The oscillator 19 generates an oscillation clock OSC.

The second controller 18 controlling the self-screen drive operates in response to the selection signal SEL of the second logic level received from the system module 30. The second controller 18 generates the second sync signal SYNC2 being a self-screen sync signal for the self-screen drive based on the oscillation clock OSC received from the oscillator 19. The second controller 18 extracts the second digital video data R2G2B2, which is synchronized with the second sync signal SYNC2 and is stored in the memory 17, and then supplies the extracted second digital video data R2G2B2 and the second sync signal SYNC2 to another input terminal of the multiplexer 15.

The second controller 18 extracts the dimming signal DIM for controlling the luminance of the backlight unit 22 from the memory 17 based on an illuminance signal IS received from the illuminance sensing unit 23.

Further, the second controller 18 updates the second digital video data R2G2B2 previously stored in the memory 17 using new second digital video data R2G2B2 received from the system module 30 every predetermined period of time. The second controller 18 will be in detail described later with reference to FIGS. 3 and 4.

The DC-DC converter 20 is an internal power supply circuit. The DC-DC converter 20 increases or reduces a first driving power DP1 received from the system module 30 to generate a plurality of voltages that will be supplied to the liquid crystal display panel 11. Examples of the voltages generated by the DC-DC converter 20 include VDD voltage, Vcom voltage, VGH voltage equal to or greater than 15V, and VGL voltage equal to or less than −4V. The VDD voltage is supplied to a gamma resistance string of the data drive circuit 12, so that the data drive circuit 12 generates the analog gamma compensation voltage. The Vcom voltage is a voltage supplied to the common electrode 2 formed on the liquid crystal display panel 11 via the date drive circuit 12. The VGH voltage is a high logic voltage of the scan pulse, which is set at a value equal to or greater than a threshold voltage of the TFT, and is supplied to the gate drive circuit 13. The VGL voltage is a low logic voltage of the scan pulse, which is set at an off-voltage of the TFT, and is supplied to the gate drive circuit 13.

The backlight drive circuit 21 generates a backlight driving signal BLD using a second driving power DP2 received from the system module 30 to drive the backlight unit 22 using the backlight driving signal BLD. In particular, the backlight drive circuit 21 generates the backlight driving signal BLD based on the dimming signal DIM received from the second controller 18 in the self-screen drive mode. The backlight driving signal BLD in the self-screen drive mode may reduce the luminance of the backlight unit 22 as compared with the normal drive mode. The backlight drive circuit 21 may include an inverter or a light emitting diode (LED) driver depending on a kind of light source constituting the backlight unit 22.

The backlight unit 22 includes a plurality of light sources or a plurality of LEDs, a side supporter, a bottom cover, a diffusion plate, a reflective sheet, and a plurality of optical sheets. Examples of the light source used in the backlight unit 22 include a cold cathode fluorescent lamp (CCFL) and an external electrode fluorescent Lamp (EEFL). The backlight driving signal BLD is generated by the inverter. In addition, if an LED is used as the light source of the backlight unit 22, the backlight driving signal BLD supplied to the LED is generated by the LED driver.

The illuminance sensing unit 23 includes one optical sensor or a plurality of optical sensors. The illuminance sensing unit 23 senses an external illuminance of an environment around the liquid crystal module 10 to generate the illuminance signal IS. The optical sensor constituting the illuminance sensing unit 23 is exposed and attached to the outside of the liquid crystal module 10. Otherwise, the optical sensor may be mounted at one side of the liquid crystal display panel 11 through a TFT process.

The system module 30 includes a microprocessor 31, a scaler unit 32, a storing unit 33, and a power unit 34.

The microprocessor 31 checks a mode signal MODE input through a user interface such as a remote controller and a selection button, controls a power supply according to a check result, and generates the selection signals SEL of the first logic level or the selection signals SEL of the second logic level. More specifically, if the microprocessor 31 receives the mode signal MODE indicating the normal drive, the microprocessor 31 allows all of powers including the powers DP1 to DP3 to be supplied to the liquid crystal module 10 and the system module 30 through the control of the power unit 34 and generates the selection signal SEL of the first logic level. On the other hand, if the microprocessor 31 receives the mode signal MODE indicating the self-screen drive, the microprocessor 31 turns off all of powers (for example, the power DP3 used to drive the scaler unit 32 and the power DP4 used to drive an audio device) except the powers DP1 and DP2 supplied to the liquid crystal module 10 through the control of the power unit 34 and generates the selection signal SEL of the second logic level opposite the first logic level. In addition, the microprocessor 31 allows new second digital video data R2G2B2 used in data update to be extracted from the storing unit 33 through the control of the power unit 34, so that a power is periodically supplied to the scaler unit 32 even in the self-screen drive mode. For this, the microprocessor 31 may include a counter unit that counts driving time and outputs a timing signal indicating an update timing every predetermined period of time. If the microprocessor 31 does not receive the mode signal MODE through the user interface, the microprocessor 31 turns off all of the powers including the powers supplied to the liquid crystal module 10 and the system module 30 through the control of the power unit 34. Hence, the microprocessor 31 allows the liquid crystal display to operate in a standby mode.

The scaler unit 32 includes an interface circuit and a graphic processing circuit. The interface circuit transfers video data of various attributes received from a storing medium such as DVD, CD, and HDD, a TV receiving circuit, etc. to the graphic processing circuit. The graphic processing circuit includes an analog-to-digital convertor (ADC) converting analog video data into digital video data, a scaler converting the digital video data in conformity with a resolution, an image processing unit compensating for a reduction in image quality resulting from changes in a resolution through a signal interpolation method, and the like. The graphic processing circuit converts the video data received from the interface circuit into the first digital video data R1G1B1 suitable for the liquid crystal display panel 11. Further, the graphic processing circuit extracts a complex video signal based on the digital video data and generates the first sync signal SYNC1 suitable for a resolution of the liquid crystal display panel 11 using the extracted complex video signal. The first sync signal SYNC1 includes a first dot clock DCLK1, a first vertical sync signal Vsync1, a first horizontal sync signal Hsync1, a first data enable signal DE1, and the like. The first digital video data R1G1B1 and the first sync signal SYNC1 generated by the graphic processing circuit are supplied to the first controller 16 of the liquid crystal module 10. The scaler unit 32 extracts new second digital video data R2G2B2, that is used to update data every predetermined period of time in the self-screen drive mode, from the storing unit 33 under the control of the microprocessor 31 to supply the new second digital video data R2G2B2 to the second controller 18 of the liquid crystal module 10.

The storing unit 33 includes data update and erasable nonvolatile memory, for example, electrically erasable programmable read-only memory (EEPROM) and/or extended display identification data (EDID) ROM. The storing unit 33 stores new second digital video data R2G2B2 used to update a display image in the self-screen drive mode. The second digital video data R2G2B2 may be updated by an electrical signal received from the outside through the user interface.

The power unit 34 is an external power circuit and generates the first driving power DP1 required to operate the DC-DC converter 20, the second driving power DP2 required to operate the backlight drive circuit 21, the third driving power DP3 required to operate the scaler unit 32, and the fourth driving power DP4 required to operate other devices including the audio device. The power unit 34 performs or cuts off a power supply under the control of the microprocessor 31.

Figure 3:
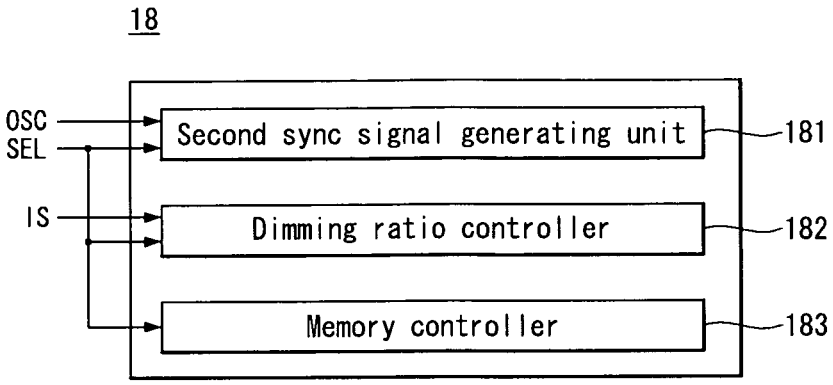
FIG. 3 illustrates a second controller.
Figure 4:
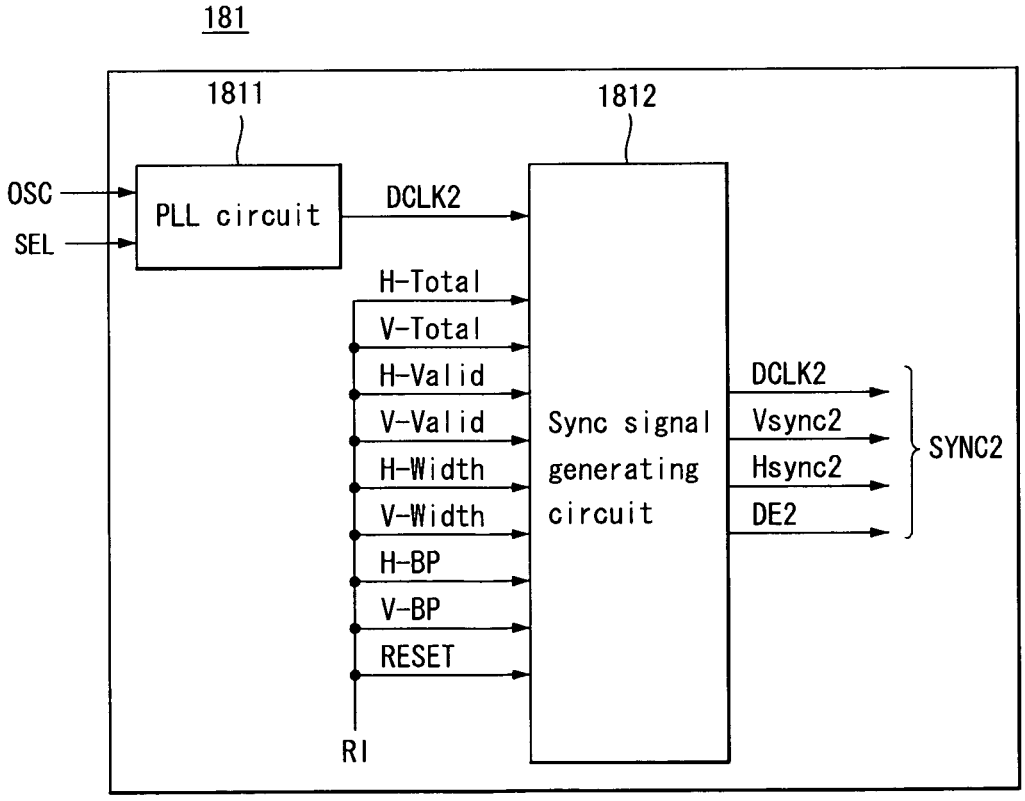
FIG. 4 illustrates a second sync signal generating unit.

FIGS. 3 and 4 illustrate the second controller 18.

As shown in FIG. 3, the second controller 18 includes a second sync signal generating unit 181, a dimming ratio controller 182, and a memory controller 183.

The second sync signal generating unit 181 generates the second sync signal SYNC2 for the self-screen drive based on resolution information RI of the liquid crystal display panel 11 in response to the selection signal SEL of the second logic level and the oscillation clock OSC received from the oscillator 19. If the liquid crystal display panel 11 is driven at a frame frequency having F-value in the normal drive, the second sync signal SYNC2 is synchronized with a minimum driving frequency, at which a flicker is invisible, among frame frequencies less than a frame frequency of F/2, so as to reduce the power consumption. For example, if the liquid crystal display panel 11 is driven at a frame frequency of 120 Hz in the normal drive, the second sync signal SYNC2 for the self-screen drive may be synchronized with the minimum driving frequency (i.e., a frame frequency of 50 Hz) to the extent that the flicker is invisible. For this, the second sync signal generating unit 181, as shown in FIG. 4, includes a phase locked loop (PLL) circuit 1811 and a sync signal generating circuit 1812.

The PLL circuit 1811 includes a well-known PLL including a voltage controlled oscillator (VCO), a divider, a temperature compensated X-tal oscillator (TCXO), a phase detector, a charge pump, and a loop filter. The PLL circuit 1811 generates a second dot clock DCLK2 using the oscillation clock OSC.

The sync signal generating circuit 1812 generates the second sync signal SYNC2 (including the second dot clock DCLK2, a second vertical sync signal Vsync2, a second horizontal sync signal Hsync2, a second data enable signal DE2, and the like in conformity with a resolution of the liquid crystal display panel 11 using the second dot clock DCLK2 and the resolution information RI. The resolution information RI includes a total of horizontal period H_Total, a total of vertical period V_Total, a horizontal valid period H_Valid, a vertical valid period V_Valid, a horizontal widt H_Width, a vertical width V_Width, a horizontal back porch H_BP, a vertical back porch V_BP, and a reset signal RESET.

The dimming ratio controller 182 generates the dimming signal DIM for reducing the luminance of the backlight unit 22 in response to the selection signal SEL of the second logic level. For this, the dimming ratio controller 182 extracts the dimming signal DIM from the memory 17 using the illuminance signal IS from the illuminance sensing unit 23 as a read address. Supposing that power consumption of the light sources having a maximum dimming ratio in the normal drive is 100%, a brightness of the light sources in the self-screen drive may be set within the range of power consumption of 10% by the dimming signal DIM. In addition, a dimming ratio of the dimming signal DIM in the self-screen drive increases as an external illuminance increases, so that the dimming signal DIM secures visibility within the range of power consumption of 10%.

The memory controller 183 controls the memory 17 in response to the selection signal SEL of the second logic level to extract the second digital video data R2G2B2 synchronized with the second sync signal SYNC2. The memory controller 183 updates the second digital video data R2G2B2 previously stored in the memory 17 using new second digital video data R2G2B2 received from the system module 30 every predetermined period of time (for example, every several tens of seconds to several minutes).

The liquid crystal display according to the embodiment of the invention synchronizes first digital video data received from the system module 30 with a first sync signal to display the first digital video data on the liquid crystal module 10 in a normal drive mode state where all of the powers are turned on. The above-described driving method of the liquid crystal display is a driving method in a general TV watching state and requires very high power consumption.

On the other hand, the liquid crystal display according to the embodiment of the invention includes a self-screen drive mode, in which only the power supplied to the liquid crystal module 10 is turned on, in addition to a standby mode, in which an image is not displayed on the liquid crystal module 10 by turning off all of the powers. In the self-screen drive mode, the liquid crystal display displays second digital video data, that is synchronized with a second sync signal generated through internal oscillation clock of the liquid crystal module 10 and is stored in an internal memory, on the liquid crystal module 10 and thus drives the liquid crystal module 10 independent of the system module 30. In the self-screen drive mode, the liquid crystal display generates a dimming signal having an ultra power-saving backlight dimming ratio to drive the light sources of the backlight unit 22. Thus, the liquid crystal display in the self-screen drive mode can greatly reduce power consumed by the light sources. Power consumption in the self-screen drive is much lower than power consumption in the normal drive. Accordingly, because the liquid crystal display displays an image like a frame at minimum power consumption, the liquid crystal display has an attractive appearance when it is not used and thus may contribute to an interior design. Namely, the liquid crystal display according to the embodiment of the invention may be implemented as an ultra power-saving TV contributing to an interior design.

Figure 5:
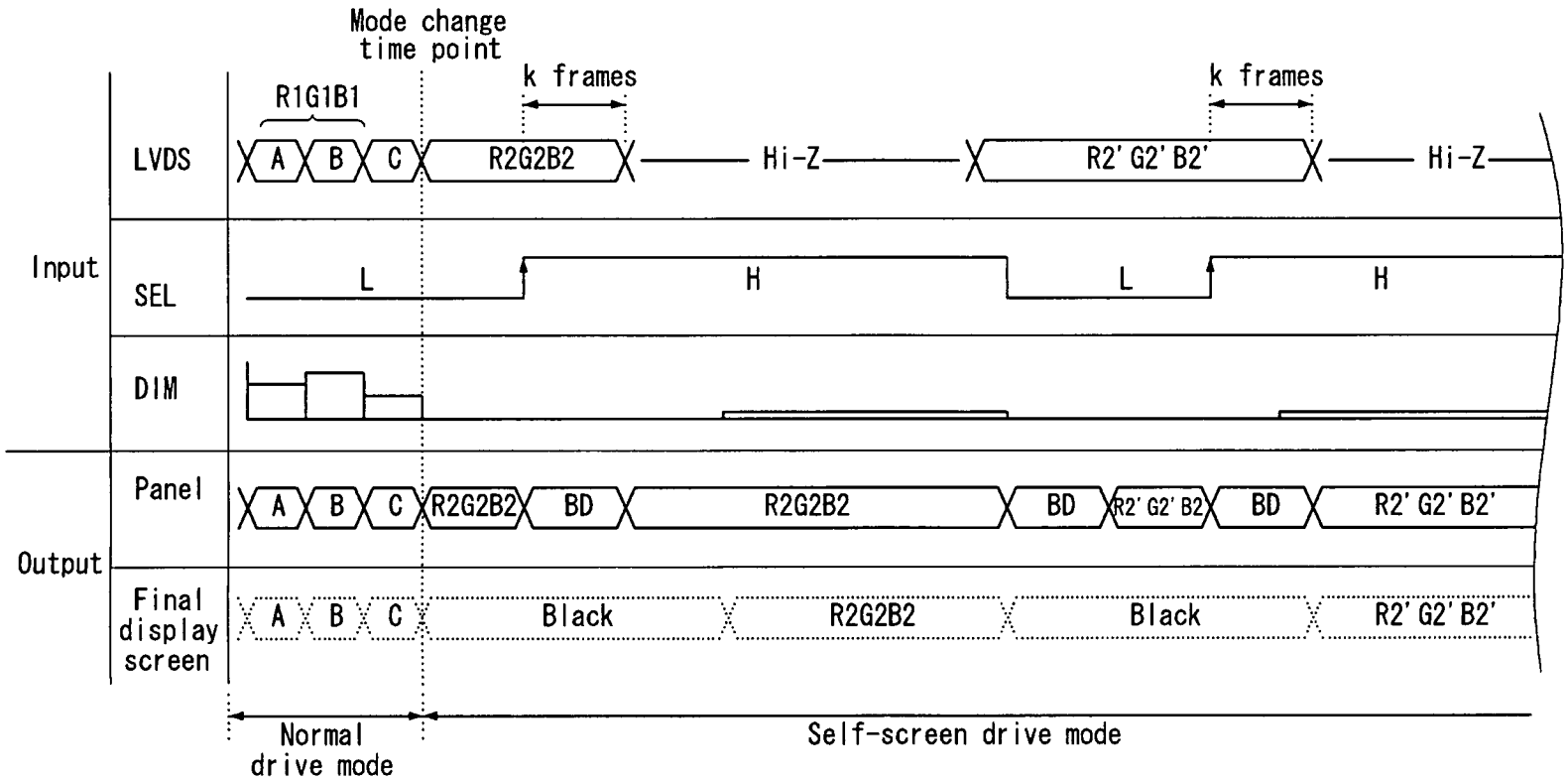
FIG. 5 is a timing diagram illustrating an interface manner between a system module and a liquid crystal module.

FIG. 5 is a timing diagram illustrating an interface manner between the system module 30 and the liquid crystal module 10. An interface circuit for the self-screen drive is the same as an interface circuit for the normal drive. In FIG. 5, HI-Z means a period where there is no signal transferred through the interface circuit for the self-screen drive.

Referring to FIGS. 2 and 5, during a period when the liquid crystal display operates in the normal drive mode, the first controller 16 synchronizes the first digital video data R1G1B1 received from the system module 30 through a low voltage differential signaling (LVDS) circuit with first sync signal SYNC1 to display the first digital video data R1G1B1 on the liquid crystal display panel 11.

On the other hand, while the second controller 18 displays a black image BLACK for removing a screen noise on the liquid crystal display panel 11 in response to the mode signal MODE indicating the self-screen drive, the second controller 18 stores the second digital video data R2G2B2 received from the system module 30 through the LVDS circuit in the memory 17. After k frame periods elapsed from immediately after a logic level of the selection signal SEL received from the system module 30 is inverted from the first logic level L to the second logic level H, the second controller 18 stores the second digital video data R2G2B2 in the memory 17 through data reduction. In particular, the second controller 18 inserts black data BD or displays the black image BLACK on the liquid crystal display panel 11 by turning off the light sources during k frame periods before and after a rising edge of the selection signal SEL, so as to remove the screen noise that is likely to be generated when the logic level of the selection signal SEL is inverted. After the second digital video data R2G2B2 is stored in the memory 17, the second controller 18 displays a stored image on the liquid crystal display panel 11 using the second sync signal SYNC2 synchronized with a frame frequency less than a frame frequency in the normal drive and drives the light sources using the dimming signal indicating a power-saving operation.

During the self-screen drive, the logic level of the selection signal SEL received from the system module 30 periodically varies, so that an image displayed on the liquid crystal display panel 11 is replaced. While the second controller 18 displays the black image BLACK for removing the screen noise on the liquid crystal display panel 11, the second controller 18 stores second digital video data R2'G2'B2' for update received from the system module 30 through the LVDS circuit in the memory 17. After the second digital video data R2'G2'B2' for update is stored in the memory 17, the second controller 18 displays a stored image on the liquid crystal display panel 11 using the second sync signal SYNC2 synchronized with a frame frequency less than a frame frequency in the normal drive and also drives the light sources using the dimming signal indicating a power-saving operation.

Figure 6:
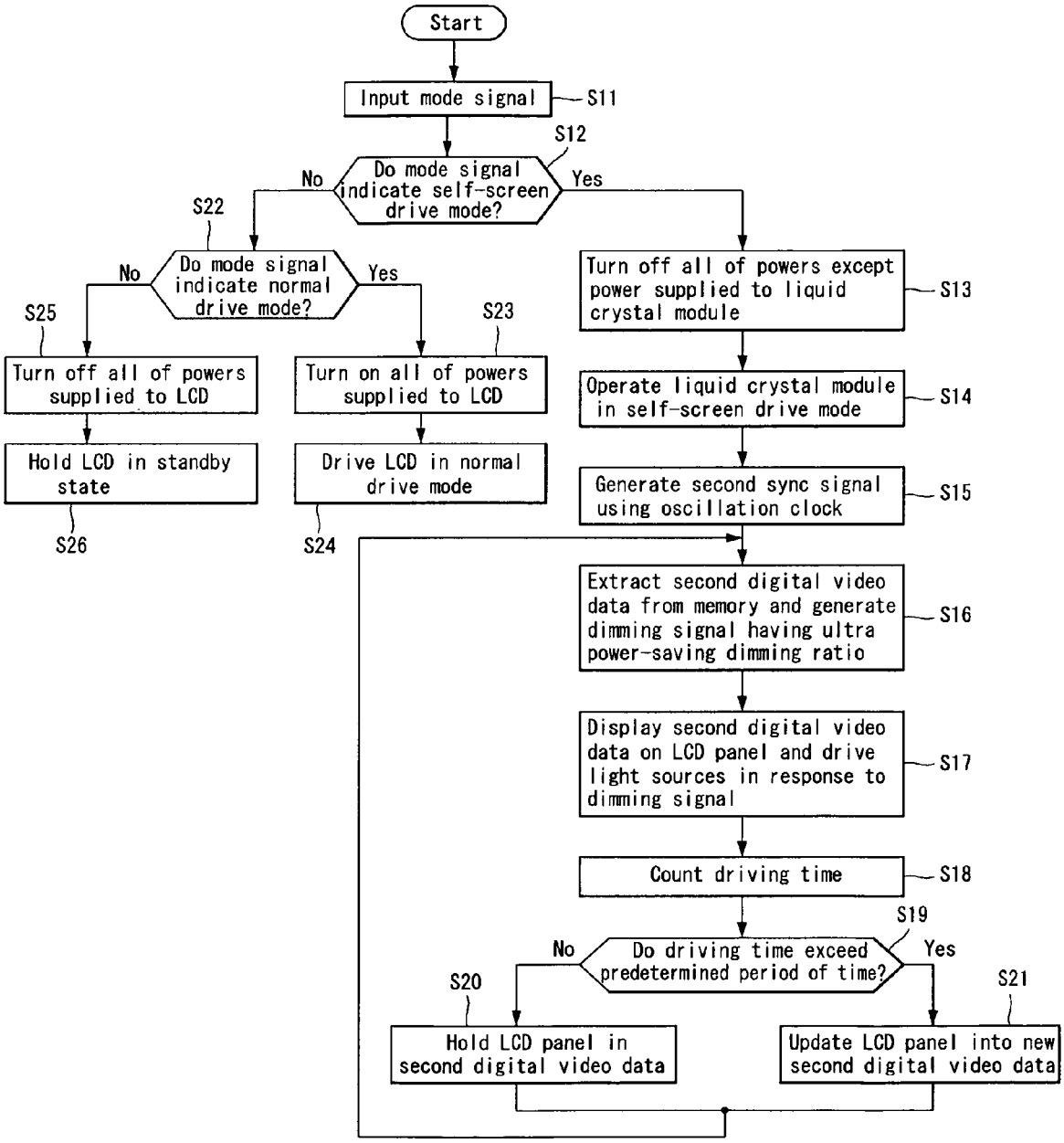
FIG. 6 is a flow chart illustrating a method of driving a liquid crystal display according to an embodiment of the invention.

FIG. 6 is a flow chart illustrating a method of driving a liquid crystal display according to an embodiment of the invention.

As shown in FIG. 6, first, if a mode signal is input through a user interface in step S11, it is decided whether or not the mode signal indicates a self-screen drive mode in step S12.

If the mode signal indicates the self-screen drive mode, all of powers (for example, a power supplied to the scaler unit and a power supplied to the audio device) except a power supplied to the liquid crystal module are turned off through the control of the power unit in step S13. The liquid crystal module operates in the self-screen drive mode using a selection signal corresponding to the self-screen drive mode in step S14.

A second sync signal being a self-screen sync signal is generated using an oscillation clock in step S15. In step S16, second digital video data is extracted from a memory installed inside the liquid crystal module using the second sync signal, an ultra power-saving dimming ratio is set so that the light sources of the backlight unit are driven at power consumption much lower than power consumption in a normal drive, and a dimming signal having the ultra power-saving dimming ratio is generated. In step S17, the second digital video data is synchronized with the second sync signal and is displayed on the liquid crystal display panel. At the same time, the light sources are driven in response to the dimming signal having the ultra power-saving dimming ratio.

Driving time in a self-screen drive mode state is counted in step S18. Then, it is decided whether or not the driving time in the self-screen drive mode exceeds a predetermined period of time in step S19.

If the driving time does not exceed the predetermined period of time, the liquid crystal display panel remains in the previously stored second digital video data (i.e., the previously stored second digital video data is displayed on the liquid crystal display panel) in step S20. On the other hand, if the driving time exceeds the predetermined period of time, the liquid crystal display panel is updated from the previously stored second digital video data into new second digital video data (i.e., the new second digital video data is displayed on the liquid crystal display panel) in step S21. After the new second digital video data is output from a storing unit installed inside the system module, the new second digital video data is stored in the memory via the scaler unit of the system module and the second controller of the liquid crystal module. For this, in the self-screen drive mode, a power supplied to the scaler unit of the system module is not turned off at all times but intermittently turned on every predetermined period of time so as to output the updated data.

If the mode signal does not indicate the self-screen drive mode in step S12, it is again determined whether or not the mode signal indicates the normal drive mode in step S22. If the mode signal indicates the normal drive mode, all of powers supplied to the liquid crystal module and the system module are turned on through the control of the power unit in step S23 and the liquid crystal display is driven in the normal drive mode in step S24. On the other hand, if the mode signal does not indicate the normal drive mode, all of powers supplied to the liquid crystal module and the system module are turned off through the control of the power unit in step S25 and the liquid crystal display remains in a standby mode in step S26.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a liquid crystal display panel;

a backlight unit that provides light to the liquid crystal display panel;

a data drive circuit that drives data lines of the liquid crystal display panel;

a gate drive circuit that drives gate lines of the liquid crystal display panel;

a backlight drive circuit that adjusts a luminance of the backlight unit;

a timing controller that supplies a video signal to the data drive circuit and generates timing control signals for controlling an operation timing of each of the data drive circuit, the gate drive circuit, and the backlight drive circuit using timing signals;

an internal memory that stores a first internal video signal for a self-screen drive;

a self-screen drive controller that generates a dimming signal having a dimming ratio less than a dimming ratio in a normal drive and generates an internal timing signal to extract the first internal video signal from the internal memory;

a scaler unit that generates an external video signal and an external timing signal for the normal drive;

a selection unit that supplies one of an output of the self-screen drive controller and an output of the scaler unit to the timing controller in response to a selection signal depending on a driving mode;

an internal power circuit that generates driving voltages required to drive the data drive circuit, the gate drive circuit, the backlight drive circuit, the timing controller, and the self-screen drive controller;

an external power circuit that generates a power input to the internal power circuit and generates a power of circuits constituting the scaler unit; and a microprocessor that blocks an output of the external power circuit from being supplied to the scaler unit to disable an operating of the scaler unit and controls the self-screen drive controller to reduce a luminance of the backlight unit in the self-screen drive, wherein the luminance of the backlight unit for the self-screen drive is less than or equal to 10% of the luminance of the backlight unit for the normal drive.

2. The liquid crystal display of claim 1, further comprising an external storing unit that stores a second internal video signal used to update the first internal video signal.

3. The liquid crystal display of claim 2, wherein the microprocessor allows an output of the external power circuit to be supplied to the scaler unit every time a driving time in the self-screen drive exceeds a predetermined period of time and thus allows the second internal video signal stored in the external storing unit to be stored in the internal memory via the scaler unit and the self-screen drive controller.

4. The liquid crystal display of claim 2, wherein the selection signal is generated by the microprocessor based on a mode signal received through a user interface, and a logic level of the selection signal changes depending on a driving mode and data update.

5. The liquid crystal display of claim 4, wherein the self-screen drive controller stores the first internal video signal in the internal memory after k frame periods elapsed from immediately after a logic level of the selection signal is inverted.

6. The liquid crystal display of claim 5, wherein the self-screen drive controller inserts black data or displays a black image on the liquid crystal display panel by turning off the backlight unit during the k frame periods on the basis of a rising edge of the selection signal, so as to remove screen noise that is likely to be generated when the logic level of the selection signal is inverted.

7. The liquid crystal display of claim 1, further comprising an oscillator that generates an oscillation clock used to generate the internal timing signal.

8. The liquid crystal display of claim 7, wherein the self-screen drive controller includes:

an internal timing signal generating unit that generates the internal timing signal using a resolution information of the liquid crystal display panel and the oscillation clock;

a dimming ratio controller that generates the dimming signal to reduce the luminance of the backlight unit; and a memory controller that controls extraction and update operations of the internal video signal.

9. The liquid crystal display of claim 8, wherein the dimming ratio controller sets a brightness of the dimming signal in the self-screen drive within range of power consumption of 10% when a power consumption of the backlight unit having a maximum dimming ratio in the normal drive is 100%.

10. The liquid crystal display of claim 9, further comprising an illuminance sensing unit that senses an external illuminance.

11. The liquid crystal display of claim 10, wherein a dimming ratio of the dimming signal in the self-screen drive increases within range of power consumption of 10% as the external illuminance increases.

12. The liquid crystal display of claim 8, wherein the internal timing signal generating unit generates an internal timing signal that corresponds to an external timing signal synchronized with a frame frequency of F-value and is synchronized with a minimum frame frequency, at which a flicker is invisible, among frame frequencies less than a frame frequency of F/2.

13. The liquid crystal display of claim 1, wherein an interface circuit for the self-screen drive is the same as an interface circuit for the normal drive.

14. A method of driving a liquid crystal display including a liquid crystal display panel, a backlight unit providing light to the liquid crystal display panel, a data drive circuit driving data lines of the liquid crystal display panel, a gate drive circuit driving gate lines of the liquid crystal display panel, a backlight drive circuit adjusting a luminance of the backlight unit, a timing controller that supplies a video signal to the data drive circuit and generates timing control signals for controlling an operation timing of each of the data drive circuit, the gate drive circuit, and the backlight drive circuit using timing signals, a scaler unit generating an external video signal and an external timing signal for a normal drive, an internal power circuit generating driving voltages required to drive the data drive circuit, the gate drive circuit, the backlight drive circuit, and the timing controller, and an external power circuit that generates a power input to the internal power circuit and generates a power of circuits constituting the scaler unit, the method comprising:

deciding whether or not a mode signal received from the outside indicates a self-screen drive;

if the mode signal indicates the self-screen drive, blocking an output of the external power circuit from being supplied to the scaler unit to disable an operating of the scaler unit, generating an internal timing signal to extract a first internal video signal previously stored for the self-screen drive from an internal memory, and generating a dimming signal having a dimming ratio less than a dimming ratio in the normal drive; and supplying the internal timing signal and the first internal video signal to the timing controller in response to a selection signal for the self-screen drive to display the first internal video signal on the liquid crystal display panel to reduce a luminance of the backlight unit using the dimming signal, wherein the luminance of the backlight unit for the self-screen drive is less than or equal to 10% of the luminance of the backlight unit for the normal drive.

15. The method of claim 14, further comprising:

allowing an output of the external power circuit to be supplied to the scaler unit every time a driving time in the self-screen drive exceeds a predetermined period of time to store a second internal video signal, that is used to update the first internal video signal and is stored in an external storing unit connected to the scaler unit, in the internal memory.

16. The method of claim 14, wherein a brightness of the dimming signal is set within range of power consumption of 10% when power consumption of the backlight unit having a maximum dimming ratio in the normal drive is 100%.

17. The method of claim 16, wherein a dimming ratio of the dimming signal increases within range of power consumption of 10% as an external illuminance increases.

18. The method of claim 14, wherein the internal timing signal corresponds to an external timing signal synchronized with a frame frequency of F-value and is synchronized with a minimum frame frequency, at which a flicker is invisible, among frame frequencies less than a frame frequency of F/2.

* * * * *